US005142124A

United States Patent [19]

Driessen

[11] Patent Number: 5,142,124

[45] Date of Patent: Aug. 25, 1992

[54] ELECTRIC IRON ARRANGEMENT WITH SELECTIVE LOCKING FOR CORDED, CORDLESS OR TRANSPORT MODES

[76] Inventor: Pieter J. Driessen, Europaweg 8, Groningen, Netherlands

[21] Appl. No.: 462,664

[22] Filed: Jan. 9, 1990

[30] Foreign Application Priority Data

Jan. 20, 1989 [NL] Netherlands ..... 8900138

[51] Int. Cl.[5] ..... D06F 75/40; D06F 79/02; H05B 1/00; H01R 33/00

[52] U.S. Cl. ..... 219/247; 38/75; 38/82; 38/142; 219/242; 219/259; 248/117.2; 439/568; 439/620

[58] Field of Search ..... 219/242, 245-247, 219/256-259; 439/568, 620; 38/75, 82, 142; 248/117.1-117.7

[56] References Cited

U.S. PATENT DOCUMENTS

| | | | |
|---|---|---|---|
| 4,784,616 | 11/1988 | Zimmerman | 439/568 |
| 4,815,992 | 3/1989 | Aranzabal | 439/620 |
| 4,943,703 | 7/1990 | Duxbury | 219/247 |
| 4,948,945 | 8/1990 | Wu | 219/247 |

FOREIGN PATENT DOCUMENTS

| | | | |
|---|---|---|---|
| 339233 | 11/1989 | European Pat. Off. | 219/247 |
| 2583792 | 12/1986 | France | 219/247 |
| 63-49199 | 3/1988 | Japan | 219/247 |
| 2179961 | 3/1987 | United Kingdom | 219/247 |
| 2211862 | 7/1989 | United Kingdom | 219/247 |

*Primary Examiner*—Anthony Bartis

[57] ABSTRACT

An electric iron arrangement has a housing provided with electrical contacts through which the heating means of the iron can be energized, a base for supporting the iron when not in use, and a detachable power cord having a connector engageable with the contacts of the iron and enabling the iron to be used for cordless or corded ironing. A three-position actuator is provided on the base for selectively actuating cooperating locking devices in the base and connector to:

(1) lock the connector to the iron to allow for corded ironing, (2) lock the connector to the base to allow for cordless ironing, or (3) lock the connector to both the iron and the base to allow for transport of the iron and base as a unit.

9 Claims, 3 Drawing Sheets

ELECTRIC IRON ARRANGEMENT WITH SELECTIVE LOCKING FOR CORDED, CORDLESS OR TRANSPORT MODES

The invention relates to an electric iron arrangement enabling an iron of the arrangement to be used selectively in either a corded more or a cordless mode. The arrangement comprises an electric iron having a housing and electrical contacts through which heating means of the iron can be energized, a base for supporting the iron when not in use, an electrical connector having a housing, an electric power cord, and electrical contacts energizable by means of the power cord and constructed to cooperate with the electrical contacts of the iron when the iron and the connector are in an interengaged position, and locking means for locking the connector to the base or to the iron. The arrangement is such that when the cordless mode is selected the electrical connector remains attached to the base while the iron is detached therefrom, and when the corded mode is selected the connector remains attached to the iron while the iron is detachable from the base.

Such an electric iron arrangement is known from Great Britain A-2,179,961.

SUMMARY OF THE INVENTION

An object of the invention is to improve the connections between the iron, the connector and the base so as to achieve a more convenient handling.

To this end the electric iron arrangement of the type defined in the opening paragraph is characterized in that the base comprises a mechanical three-position actuator for actuating the locking means to lock the electrical connector either to the iron or to the base, or both to the iron and the base.

The three-position actuator enables the user to simple establish a mechanical locking:

(a) between the iron and the connector, the connector not being locked to the base (corded mode), (b) between the base and the connector, the connector not being locked to the iron (cordless mode), (c) between the iron and the connector and between the base and the connector.

This last-mentioned mode is intended as a storage or transport mode for the complete arrangement, for example for storage in a cupboard or for transport from the factor. To move the entire arrangement the user merely has to hold the iron.

A preferred embodiment of the electric iron arrangement is characterized in that the locking means comprise:

a first locking device arranged in the base to lock the connector to the base, and a second locking device arranged in the connector to lock the connector to the iron, the second locking device being operable by the first locking device and the first locking device being operable by the three-position actuator.

the two locking devices are, in effect, arranged in series with the actuator, enabling a comparatively small number of parts to be used.

A further embodiment is characterized in that the second locking device comprises two elements which are spring-biased in opposite directions, one end of each element being provided with a locking wing, which locking wings are movable through respective openings in a wall of the connector housing to cooperate with corresponding recesses in the housing of the iron. The locking wings enable the connector to be coupled to the iron. The iron can be locked to the connector even when the locking wings project from the housing. For this purpose the locking wings and/or a housing wall of the iron which cooperates with the wings each have a beveled edge. When the iron is placed against the connector the beveled edges press the locking wings inward until they snap into the recesses in the housing of the iron.

Yet another embodiment is characterized in that the first locking device comprises a pusher, which is movable against spring bias through an opening in a wall of the housing of the base and through a corresponding opening in a wall of the connector housing to lock the connector to the base and to actuate the second locking device.

The actuator may be arranged in the base so as to be rotatable or slidable. When the iron/connector combination is placed on the base the pusher is depressible from a position in which it projects from the housing of the base. The pusher then presses the actuator back into its correct position, i.e. the position for the corded mode.

Preferably, retaining means are provided between the connector and the base and between the connector and the iron. These means may comprise a projection and a corresponding recess or the other way around. In combination with the locking means this provides an effective interlocking of the parts of the arrangement and a simple operation.

DETAILED DESCRIPTION OF PREFERRED EMBODIMENTS

Figure 1:
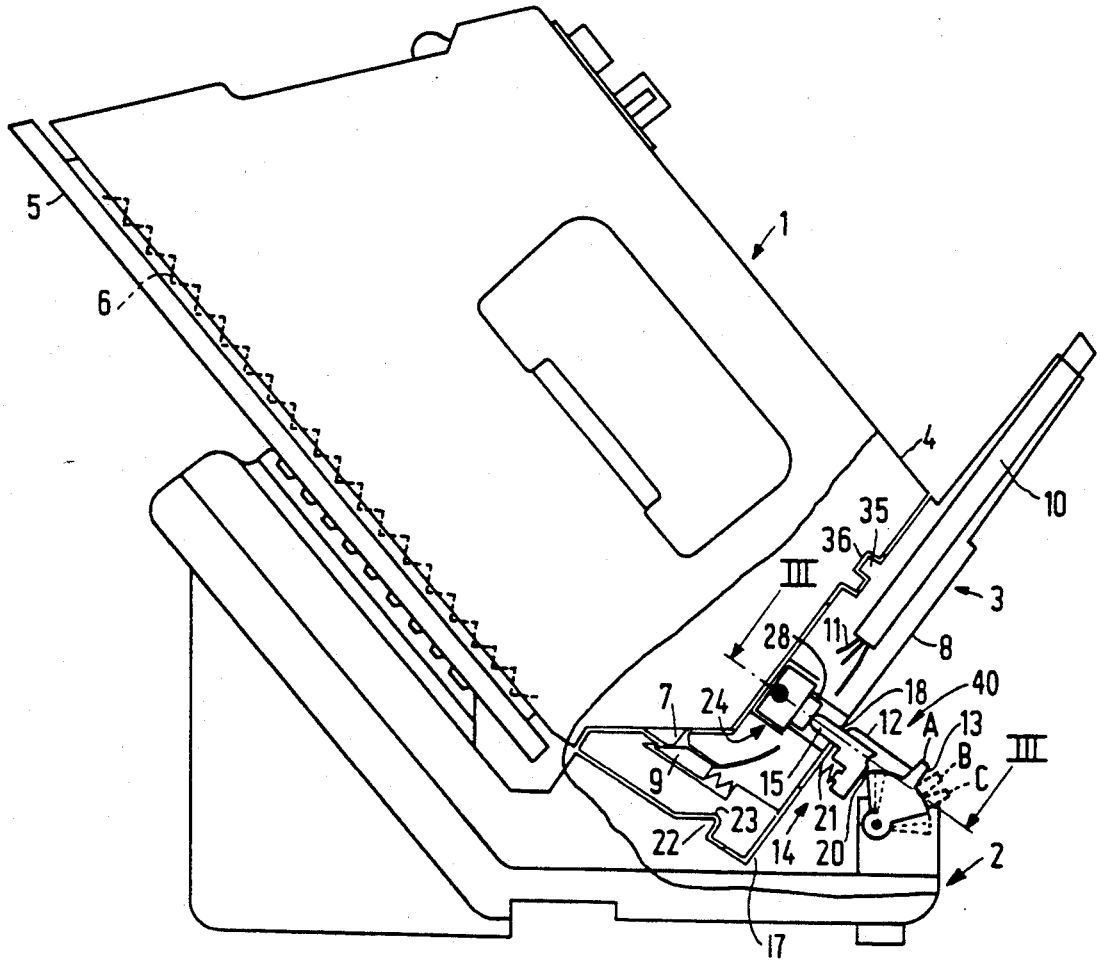
FIG. 1 is a diagrammatical view of the electric iron arrangement.
Figure 2:
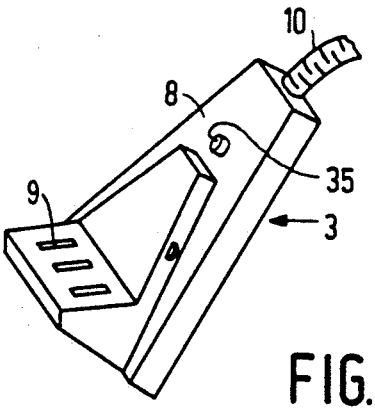
FIG. 2 is an enlarged-scale sectional view taken on the line III—III in FIG. 1, showing the arrangement in the cordless mode (A)

An embodiment of the invention will now be described in more detail, by way of example, with reference to the accompanying drawings.

The electric iron arrangement comprises an electric iron 1, a base 2 for supporting the iron when it is not in use, and an electrical connector 3. The iron comprises a housing 4 having a soleplate 5, which is heated by an electric heating element 6 which is energizable through electrical contacts 7. The connector 3 has a housing 8, electrical contacts 9 and an electric power cord 10, whose electrical conductors 11 are connected to the contacts 9. The housing 4 of the iron and the housing 8 of the connector are shaped in such a manner that when they are placed against each other the electrical contacts 7 of the iron established an electrical connection with the electrical contacts 9 of the connector. The base 2 comprises a housing 12 which is shaped to cooperate with the connector 9.

The arrangement comprises locking means for interlocking the parts of the arrangement. For this purpose the base 2 is provided with a mechanical three-position actuator 13 enabling the locking means to be actuated. In a first position A the connector 3 is locked to the base 2 but not to the iron 1 (cordless mode). In a second position B the connector is locked both to the iron and to the base (transport mode). In the third position C the iron is locked to the connector and not to the base (corded mode).

Figure 5:
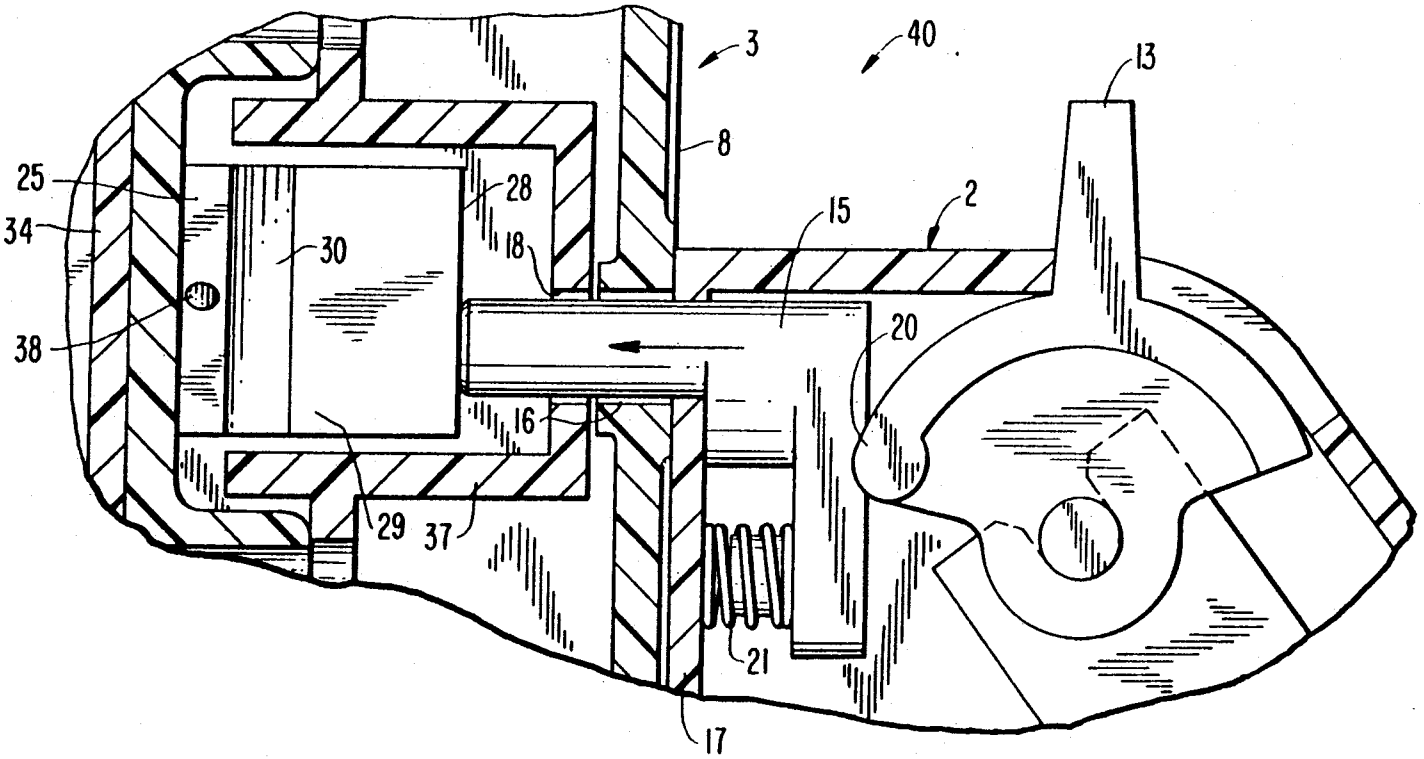
FIG. 5 is an enlarged sectional view showing the area designated 40 in FIG. 1.

The locking means comprise a first locking device 14 comprising a pusher 15 which is spring-mounted in the base 2. The pusher is movable through an opening 16 in a wall 17 of the housing 12 of the base so as to project partly from this housing. When the connector 3 is placed on the base pusher 15 moves through an opening 18 in a wall 19 of the connector housing 8. The pusher 15 is actuated by the actuator 13. The actuator is rotatably supported in the base 2. One end 20 of the actuator is in direct contact with the pusher 15. Rotation of the actuator causes the end 20 to slide along the pusher 15, which is moved against the spring bias exerted by the spring 21 (See FIG. 1, in particular the area designated 40 which is shown as an enlarged section in FIG. 5). In two positions (A and B) the pusher projects from the base into the connector housing 8. The connector 3 is locked to the base 2 with the aid of retaining means comprising a projection 22 of the base and a corresponding recess 23 in the connector.

The latching means further comprise a second locking device 24 arranged in the connector 3. This second locking device comprises two elements 25 which are spring-biased in opposite directions and which each comprise a locking wing 26 at one end. The elements 25 are slidably supported in the connector housing 8 and are urged away from each other by a spring 27. The latching device further comprises a U-shaped slide 28 whose limbs have ends 29 which slidingly cooperate with included surfaces 30 of the elements 25. The slide is movable under the influence of the pusher 15. Each of the locking wings 26 is movable through an opening 31 in a wall 32 of the connector housing 8 to a position outside the connector housing. When the iron 1 and the connector 3 are placed against each other and the locking wings 26 are moved outward the wings engage in recesses 33 in the rear wall 34 of the housing 4 of the iron. The connector is thus locked to the iron. Retaining means, comprising a projection 35 of the connector and a corresponding recess 36 in the iron, ensure that the connector is positioned correctly relative to the iron.

Figure 3:
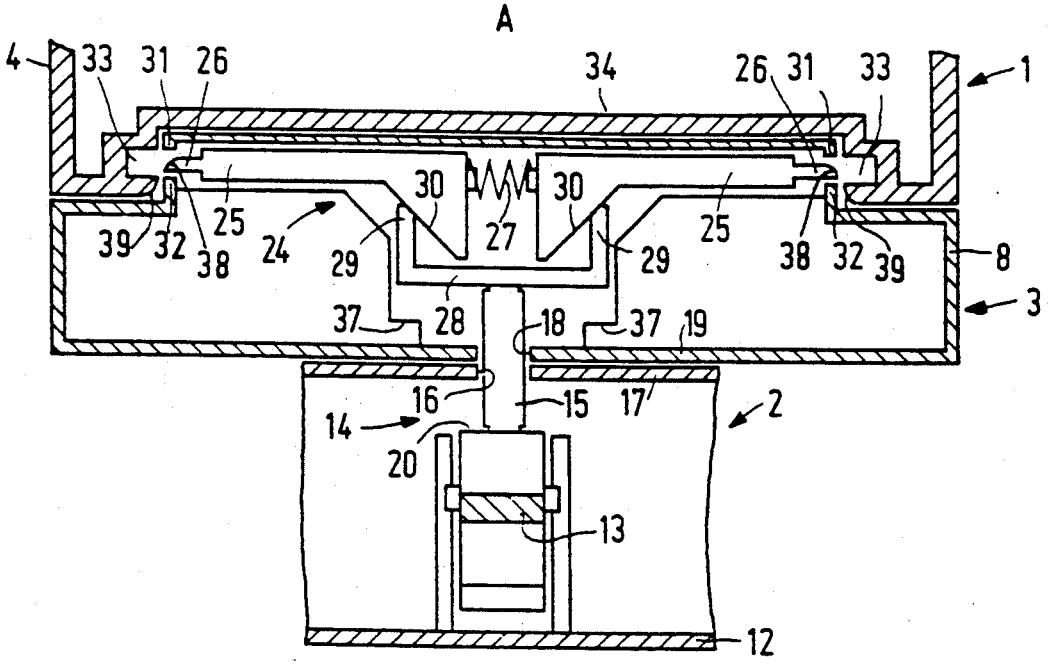

The locking mechanism operates as described in the following example:

In position A (FIG. 3) of the actuator the first locking device 14 comprising the pusher 15 is moved as far as possible into the connector housing 8 and thereby retains the U-shaped slide 28, so that the elements 25 are retained against the pressure of the spring 27 and the locking wings 26 are situated wholly inside the connector housing. The iron 1 is now detachable from the connector 3. The connector remains locked to the base 2 by means of the pusher 15 and the retaining means 22, 23. This is the cordless mode.

Figure 4:
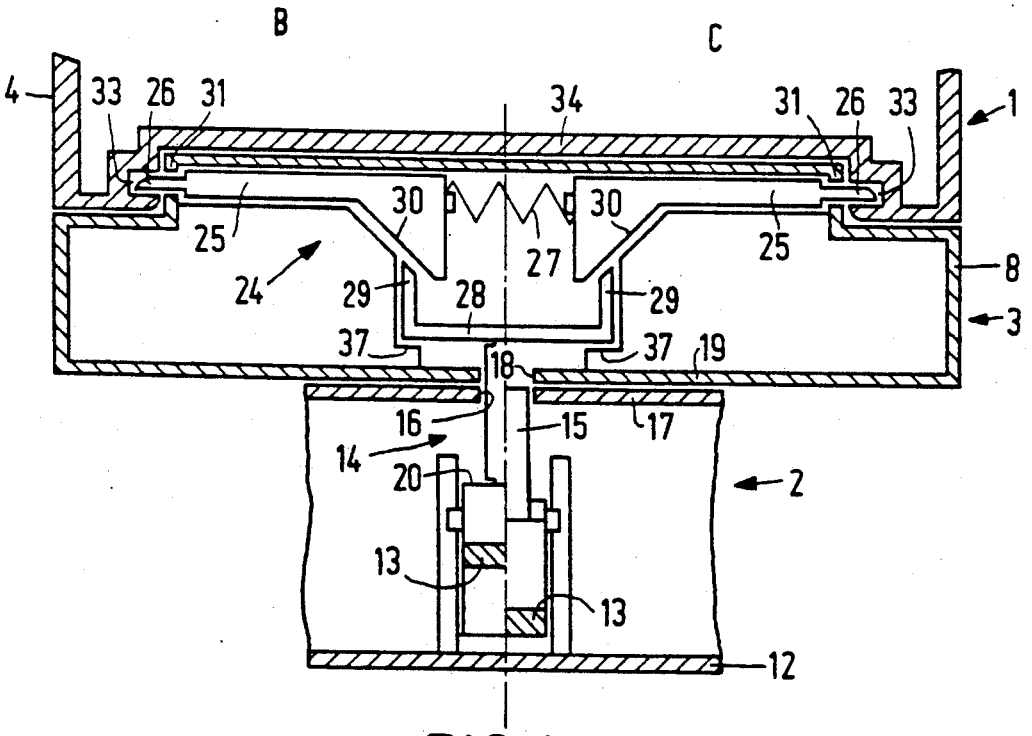
FIG. 4 is a sectional view of the arrangement similar to FIG. 3, the left-hand part illustrating the transport mode (B) and the right-hand part illustrating the corded mode (C)

When the actuator is rotated from position A to position B (left-hand part of FIG. 4) the spring 21 urges back the pusher 15, so that the elements 25 are pressed away from each other by the spring 27 and the locking wings 26 are situated outside the connector housing 8. The slide 28 is also urged back against the stop 37. When the iron 1 is placed onto the base 2 against the connector 3 the locking wings 26 engage the recesses 33 and thereby lock the iron to the connector. The connector remains locked to the base because the pusher 15 is still situated in the connector housing. The iron, the connector and the base are interlocked in this position, which is consequently the transport position.

When the actuator 13 is rotated from position B into position C (right-hand part of FIG. 4) the pusher 15 is pushed back further and is situated wholly inside the base. The locking wings 26 remain in the outward position to lock the iron. When the iron is removed the connector with the power cord remains attached to the iron. This is the corded mode.

If the iron 1 is connected to the connector 3 for corded operation and the actuator 13 is in position A or position B (cordless mode or transport mode), the pusher 15 being situated outside the housing 12 of the base 2, the iron (with the connector) can still be readily replaced onto the base. The housing 8 of the connector then presses the pusher 15 inward, thereby resetting the actuator 13 to position C (corded mode).

The iron 1 can also be locked to the connector 3 when the locking wings 26 project from the connector housing 8, i.e. when the actuator 13 is in position B or C. For this purpose the latching wings 26 and/or the edge portions of the rear wall 34 of the iron have beveled edges 38 and 39 respectively, so that the locking wings are pressed inward and snap into the recesses 33 when the iron is placed against the connector.

It is obvious that a slide actuator may be used instead of a rotatable switch 13. Such a slide actuator may then be integral with the pusher.

What is claimed is:

1. An electric iron arrangement enabling an iron of the arrangement to be used selectively in either a corded mode or a cordless mode, the arrangement comprising an electric iron having a housing and electrical contacts through which the electric heating means of the iron can be energized, a base for supporting the iron when not in use, an electrical connector having a housing, an electric power cord, electrical contacts energizable by means of the power cord and constructed to cooperate with the electrical contacts of the iron when the iron and the connector are in an interengaged position, and locking means operatively associated with said iron, base and connector for selectively locking the connector to the base or to the iron, the arrangement being such that when the cordless mode is selected the electrical connector remains attached by said locking means only to the base while the iron is detached therefrom, and when the corded mode is selected the connector remains attached to the iron while the iron is detachable from the base, the base comprising a mechanical three-position actuator for actuating the locking means in the first actuator position to lock the electrical connector only to the base, in the second actuator position to lock the connector to both the base and the iron, and in the third actuator position to lock the connector only to the iron.

2. An electric iron arrangement as claimed in claim 1, wherein the locking means comprise a first locking device arranged in the base to lock the connector to the base, and a second locking device arranged in the connector to lock the connector to the iron, the second locking device being operable by the first locking device and the first locking device being operable by the three-position actuator.

3. An electric iron arrangement as claimed in claim 2, wherein the second locking device comprises two elements which are spring-biased in opposite directions, one end of each element being provided with a locking wing, which locking wings are movable through respective openings in a wall of the connector housing to cooperate with corresponding recesses in the housing of the iron.

4. An electric iron arrangement as claimed in claim 3, wherein at least one of the locking wings and/or a housing wall of the iron which cooperates with the wings have a beveled edge.

5. An electric iron arrangement as claimed in claim 2, 3 or 4, wherein the base comprises a housing, the first locking device comprises a pusher, which is movable against spring bias through an opening in a wall of the housing of the base and through a corresponding opening in a wall of the connector housing to lock the connector to the base and to actuate the second locking device.

6. An electric iron arrangement as claimed in claim 5, wherein the pusher is arranged to be slidable in the housing of the base and the actuator is rotatably supported in the base, the pusher being actuated by one end of the actuator.

7. An electric iron arrangement as claimed in claim 6, wherein the pusher is depressible from a position in which it projects from the housing, of the base in response to the iron/connector combination being placed on the base.

8. An electric iron arrangement as claimed in claim 1, wherein first retaining means are arranged between the connector and the base to facilitate locking the connector to the base.

9. An electric iron arrangement as claimed in claim 1, wherein second retaining means are arranged between the connector and the iron to facilitate locking the connector to the iron.

* * * * *